US008439705B2

(12) United States Patent
Zhang

(10) Patent No.: US 8,439,705 B2
(45) Date of Patent: May 14, 2013

(54) MODULAR JACK WITH SHEILDING PLATE BETWEEN MAGNETIC COMPONENTS

(75) Inventor: Jie Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/241,292

(22) Filed: Sep. 23, 2011

(65) Prior Publication Data

US 2012/0115362 A1 May 10, 2012

(51) Int. Cl.
*H01R 13/66* (2006.01)

(52) U.S. Cl.
USPC ..... 439/607.06

(58) Field of Classification Search ..... 439/620.06, 439/620.04, 676, 607.38, 620.07, 620.18
See application file for complete search history.

(56) References Cited

U.S. PATENT DOCUMENTS 4,834,664 A * 5/1989 Lin ..... 439/145
5,556,308 A * 9/1996 Brown et al. ..... 439/746
5,595,503 A * 1/1997 Pittman et al. ..... 439/446
5,730,631 A * 3/1998 Tsang ..... 439/881
6,099,338 A * 8/2000 Huang ..... 439/350
6,290,533 B1 * 9/2001 Major ..... 439/490
6,644,984 B2 * 11/2003 Vista et al. ..... 439/76.1
6,769,936 B2 * 8/2004 Gutierrez et al.
7,210,969 B1 * 5/2007 Hashimoto ..... 439/751
7,377,802 B2 * 5/2008 Allen ..... 439/490
7,563,139 B1 * 7/2009 Wang ..... 439/638
7,766,681 B1 * 8/2010 Wang ..... 439/276
2011/0167869 A1 * 7/2011 Geers et al.

FOREIGN PATENT DOCUMENTS

CN 201430318 Y * 3/2010

* cited by examiner

*Primary Examiner* — Alexander Gilman

(74) *Attorney, Agent, or Firm* — Wei Te Chung; Ming Chieh Chang

(57) ABSTRACT

An electrical connector (100) includes an insulative housing (2) defining a receiving cavity (20) for insertion of a mating connector, a terminal module (3) including a number of mating terminals (311) projecting into the receiving cavity and a number of magnetic components connected with the mating terminals, and a respective shielding plate (33) located between adjacent magnetic components to reduce crosstalk.

20 Claims, 5 Drawing Sheets

MODULAR JACK WITH SHEILDING PLATE BETWEEN MAGNETIC COMPONENTS

BACKGROUND OF THE INVENTION

1. Field of the Invention

The present invention relates to a modular jack, and particularly, to a modular jack with a shielding plate for reducing crosstalk between magnetic components.

2. Description of Related Art

Chinese Patent No. 200920302296.7 issued on Mar. 24, 2010, discloses an electrical connector mounted on a printed circuit board (PCB). The electrical connector includes a housing defining a receiving room for insertion of a mating connector, and a contact module assembled on the housing. The contact module has a terminal group projecting into the receiving room and a number of magnetic components electrically connecting with the terminal group. There are no shielding members located among magnetic components to reduce crosstalk therebetween. U.S. Pat. No. 6,769,936 issued on Aug. 3, 2004 discloses an electrical connector having a plurality of electrical components disposed on a substrate. The electrical components are encapsulated in silicon or similar encapsulant for electrical isolation, but it is inconvenient for mass production.

Hence, an improved connector is desired to overcome the above problems.

SUMMARY OF THE INVENTION

A primary object of the present invention is to provide an electrical connector having shielding plate capable of reducing crosstalk between magnetic components to an acceptable level.

To achieve the aforementioned object, an electrical connector includes an insulative housing defining a receiving cavity for insertion of a mating connector, a terminal module including a number of mating terminals projecting into the receiving cavity and a number of magnetic components connected with the mating terminals, and at least one shielding plate located between adjacent magnetic components.

The foregoing has outlined rather broadly the features and technical advantages of the present invention in order that the detailed description of the invention that follows may be better understood. Additional features and advantages of the invention will be described hereinafter which form the subject of the claims of the invention.

DETAILED DESCRIPTION OF THE INVENTION

Figure 1:
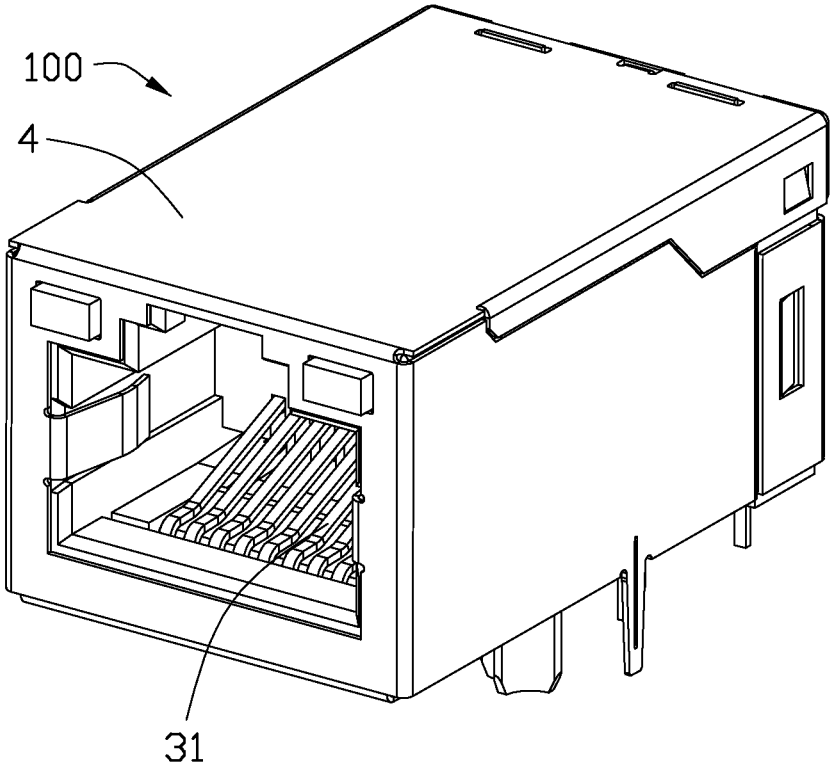
FIG. 1 is an assembled perspective view of an electrical connector in accordance with the embodiment of the present invention.
Figure 2:
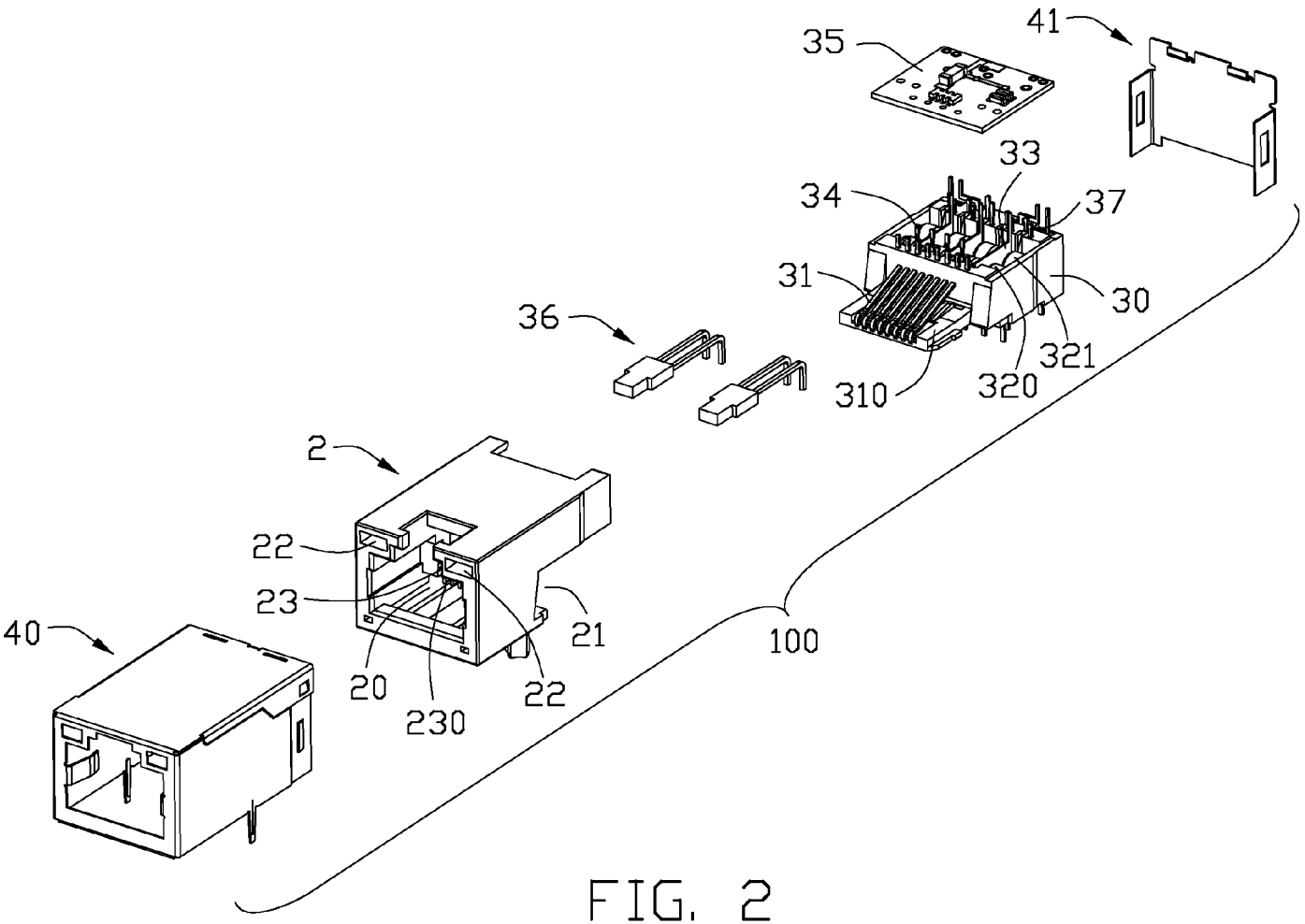
FIG. 2 is an exploded perspective view of the electrical connector as shown in FIG. 1.
Figure 3:
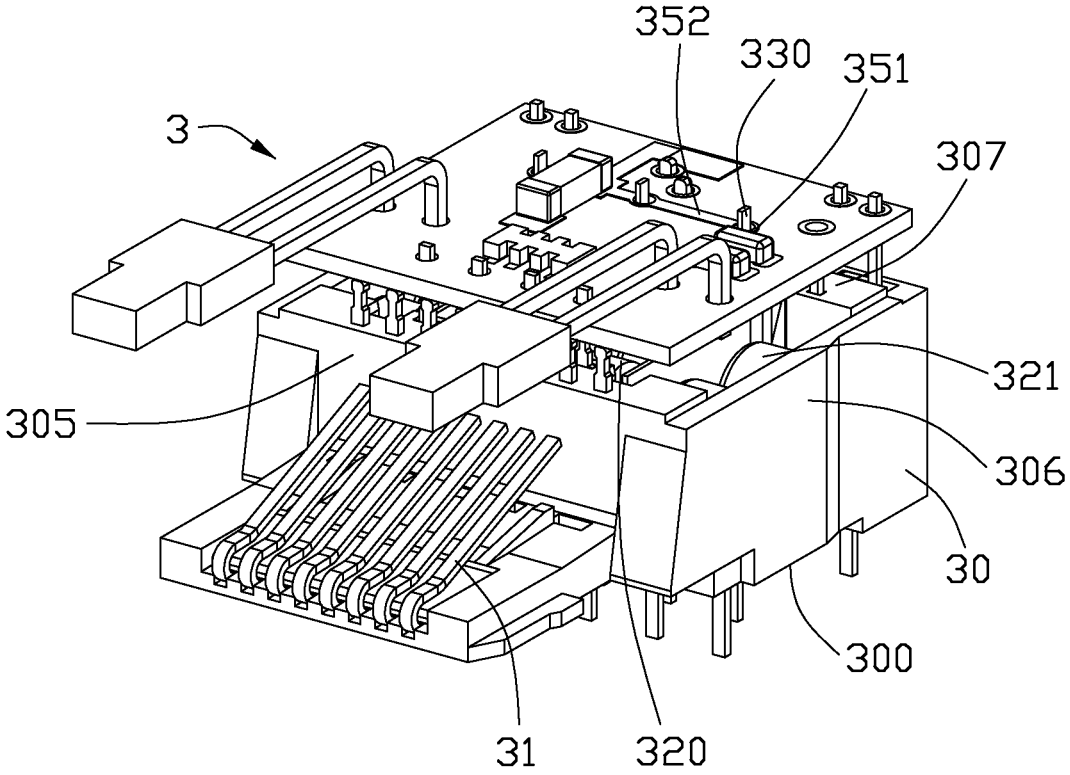
FIG. 3 is an assembled perspective view of a terminal module of the electrical connector as shown in FIG. 2.

Reference will now be made to the drawing figures to describe the present invention in detail. Referring to FIGS. 1-3, an electrical connector 100 in accordance with the embodiment of the present invention is mounted on an outer printed circuit board (not shown). The connector 100 comprises an insulative housing 2, a terminal module 3 received in the insulative housing 2, and a shielding shell 4 including a front shell 40 and a rear shell 41 and covering the insulative housing 2.

Referring to FIG. 2, the insulative housing 2 defines a receiving cavity 20 for insertion of a mating connector (not shown), a receiving room 21 communicating with the receiving cavity 20, and a pair of recesses 22 located above the receiving cavity 20 along a mating direction for insertion of a pair of LEDs 36. The insulative housing 2 includes a holding portion 23 positioned between the receiving cavity 20 and the receiving room 21 and extending downwardly and defining a plurality of grooves 230 for retaining terminals.

Figure 4:
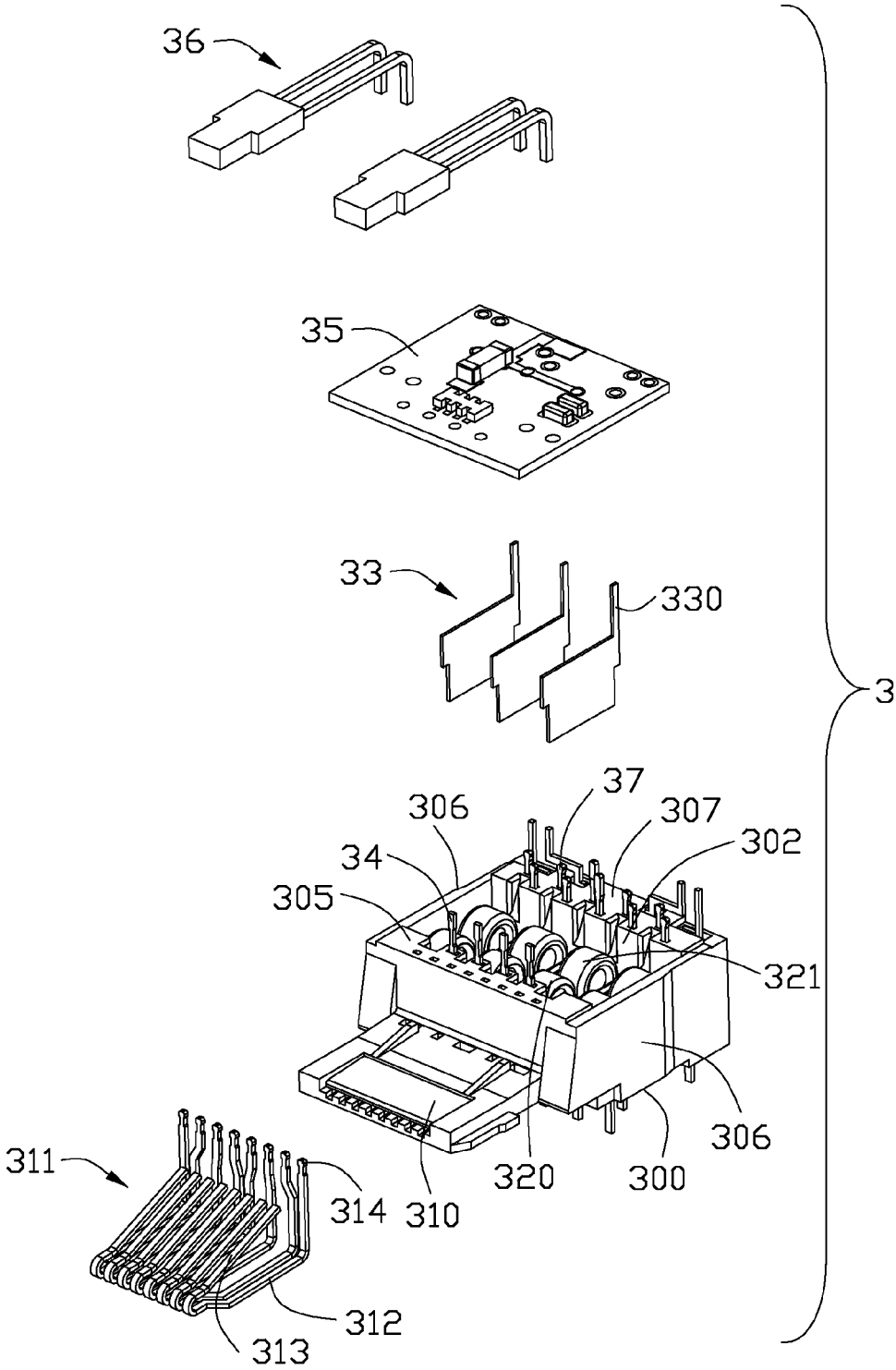
FIG. 4 is an exploded perspective view of the terminal module as shown in FIG. 3.

Referring to FIGS. 2-4, The terminal module 3 is received into the receiving room 21 along a direction reverse to the mating direction. The terminal module 3 includes a base portion 30, a terminal group 31 ahead of the base portion 30 projecting into the receiving cavity 20 and electrically connecting with the mating connector, a plurality of magnetic components received in the base portion 30, and an inner printed circuit board (PCB) 35 positioned horizontally above the base portion 30 with the LEDs 36 soldered thereon. The terminal group 31 includes a tongue portion 310 and a plurality of mating terminals 311 secured on the tongue portion 310. The tongue portion 310 is molded with the base portion 30 integrately and extends forwardly horizontally. Optionally, the tongue portion 310 also could be molded independently and then assembled with the base portion 30. Each mating terminal 311 has a retaining portion 312 extending horizontally and secured in the tongue portion 310, a contacting portion 313 extending obliquely backwardly from one end of the retaining portion 312, and a positioning portion 314 extending from the other end of the retaining portion 312 vertically.

Figure 5:
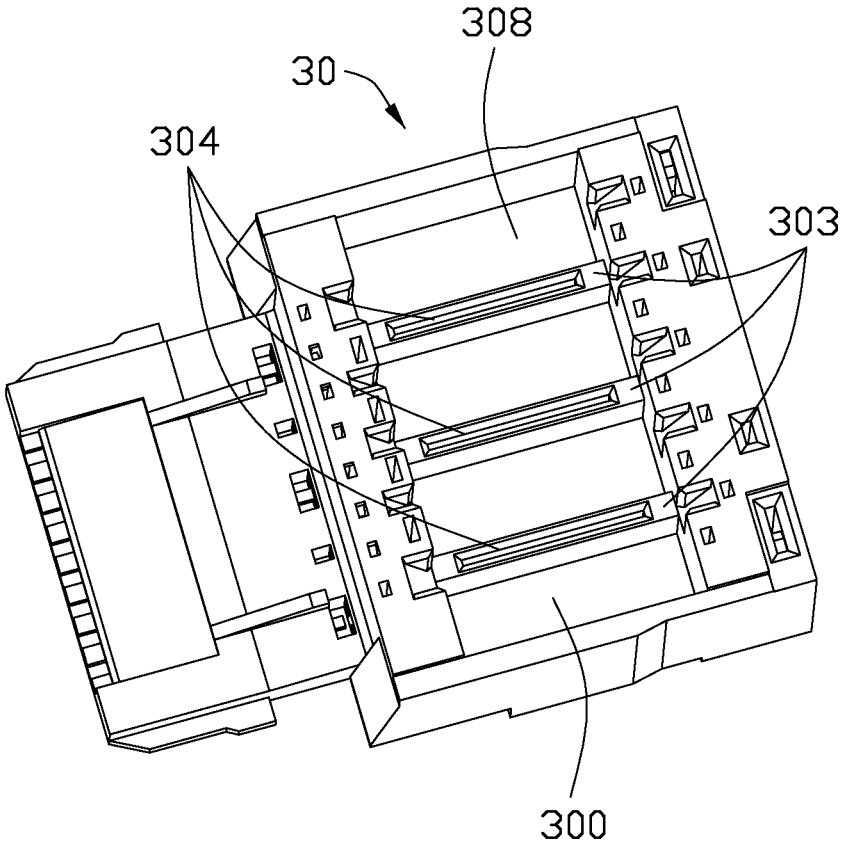
FIG. 5 is a perspective view of a base portion of the terminal module as shown in FIG. 4.

Referring to FIGS. 4-5, The base portion 30 has a lower wall 300, a front wall 305 perpendicular to the lower wall 300, a rear wall 307 opposite to the front wall 305, and a pair of side walls 306 connecting the front wall 305 and the rear wall 307 thereby defining a chamber 302 for receiving a plurality of magnetic components. The inner PCB 35 covers the chamber 302 and is opposite to the lower wall 300. The positioning portion 314 of the mating terminal 311 is retained in the front wall 305, with a tail of the positioning portion 314 extending beyond the top surface of the front wall 305. The terminal module 3 also includes a plurality of first contacts 34 retained in the front wall 305 and then soldered on the inner PCB 35, and a plurality of second contacts 37 retained in the rear wall 307 and electrically connecting magnetic components and the outer PCB. A plurality of dividing walls 303 extend upwardly from the lower wall 300 and are parallel to the side wall 306 and project into the chamber 302 to divide the chamber 302 into a number of rooms 308. Each dividing wall 303 connects the front wall 305 and the rear wall 307 and defines a retaining slot 304 therein for receiving a shielding plate 33.

Each shielding plate 33 is made of metallic material and is configured into a flat sheet with a soldering foot 330 formed extending upwardly to solder on the connection region 351 the inner PCB 35 wherein the connecting regions 351 are linked by a linking trace 352. Each shielding plate 33 is downwardly inserted into one corresponding retaining slot 304. Each magnetic component includes a transformer 320 and a common mode choke 321 forming a filtering device which is put into one room 308. Every shielding plate 33 is located between neighboring filtering device and reduces crosstalk between neighboring filtering device. Every filtering device includes a plurality of wires wound on the positioning portions 314 and on the second contacts 37.

It is not necessary to put every retaining slot 304 with shielding plate 33. It can only put a shielding plate 33 to one of the retaining slot 304 as required. In other words, at least a shielding plate 33 is located in the chamber 302 between neighboring magnetic components. The crosstalk between the neighboring magnetic components is reduced due to the shielding plate 33 situated between the neighboring magnetic components.

However, the disclosure is illustrative only, changes may be made in detail, especially in matter of shape, size, and arrangement of parts within the principles of the invention.

What is claimed is:

1. An electrical connector comprising:

an insulative housing defining a receiving cavity for insertion of a mating connector;

a terminal module including a plurality of mating terminals projecting into the receiving cavity, a plurality of magnetic components connected with the mating terminals, and a base portion defining a chamber receiving said magnetic components; and at least one shielding plate located between adjacent magnetic components;

wherein said base portion has a plurality of dividing walls projecting into the chamber to divide the chamber into a number of rooms each accommodating a corresponding magnetic component, said at least one shielding plate being retained in one of the dividing walls.

2. The electrical connector as claimed in claim 1, wherein there are a plurality of shielding plates each situated between a pair of neighboring magnetic components.

3. The electrical connector as claimed in claim 2, wherein said shielding plate is made of metallic material and is configured into a flat sheet.

4. The electrical connector as claimed in claim 3, wherein said plurality of shielding plates are parallel with each other.

5. The electrical connector as claimed in claim 2, wherein each magnetic component includes a transformer and a common mode choke forming a filtering device.

6. The electrical connector as claimed in claim 1, wherein said terminal module includes an inner PCB (printed circuit board) covering the chamber, each shielding plate having a soldering foot soldered on the inner PCB.

7. The electrical connector as claimed in claim 6, wherein said inner PCB extends horizontally, and said shielding plate is perpendicular to the inner PCB with the soldering foot extending upwardly.

8. The electrical connector as claimed in claim 1, wherein each dividing wall defines a retaining slot therein for receiving the shielding plate.

9. The electrical connector as claimed in claim 1, wherein said base portion has a lower wall, a front wall perpendicular to the lower wall, a rear wall opposite to the front wall, and a pair of side walls connecting the front wall and the rear wall, said dividing wall extending upwardly from the lower wall and being parallel with each other.

10. The electrical connector as claimed in claim 9, wherein each dividing wall connects the front wall and the rear wall and is parallel to the side wall.

11. The electrical connector as claimed in claim 10, wherein said shielding plate is downwardly inserted into the retaining slot and has a soldering foot formed at an upper portion thereof.

12. An electrical connector comprising:

an insulative housing defining a front mating port and rear mounting port;

a plurality of terminals located in the mating port;

a base portion located on the mounting port and defining a receiving space;

a plurality of magnetic components received in the receiving space and electrically connected to the corresponding terminals; and a plurality of metallic shielding plates received in the receiving space; wherein each of said shielding plates is located between every adjacent corresponding two magnetic components; wherein an inner printed circuit board horizontally extends above the base portion, each of said magnetic components is located under and electrically connected to said inner printed circuit board, and each of said shielding plates is located under and electrically and mechanically connected to said inner printed circuit board.

13. The electrical connector as claimed in claim 12, further including a pair of LEDs (Laser Emitting Diode) electrically and mechanically connected to the inner printed circuit board; wherein the LEDs are located on an upper side of the inner printed circuit board while the terminals, the magnetic components and the shielding plates are located on an underside of the inner printed circuit board.

14. The electrical connector as claimed in claim 13, wherein said terminals are integrally formed with a tongue portion with a pitch of tail portions of the terminals is larger than that of contacting portions of the terminals.

15. The electrical connector as claimed in claim 14, wherein the tongue portion is associated with the base portion.

16. The electrical connector as claimed in claim 13, wherein said base portion has a plurality of dividing walls projecting into the receiving space to divide the receiving space into a number of rooms each accommodating a corresponding magnetic component, each shielding plate being retained in a corresponding one of the dividing walls.

17. An electrical connector comprising:

an insulative housing defining a front mating port and a rear mounting port along a front-to-back direction;

a plurality of terminals located in the mating port;

a plurality of magnetic components located around the mounting port;

an inner printed circuit board horizontally located behind the mating port along the front-to-back direction, to which both the magnetic components and the terminals are electrically and mechanically connected; and a plurality of metallic shielding plates further electrically and mechanically connected to the printed circuit board; wherein each of said shielding plates is located between every adjacent corresponding two magnetic components; wherein each of said shielding plates defines a connecting foot electrically and mechanically connected to a connection region of the printed circuit board, and said inner printed circuit board defines a linking trace linking said connection regions together for common grounding.

18. The electrical connector as claimed in claim 17, further including a pair of LEDs (Laser Emitting Diode) electrically and mechanically connected to the inner printed circuit board; wherein the LEDs are located on an upper side of the inner printed circuit board while the terminals, the magnetic components and the shielding plates are located on an underside of the inner printed circuit board in a vertical direction perpendicular to said front-to-back direction.

19. The electrical connector as claimed in claim 17, further including a base portion located on the mounting port and defining a receiving space equipped with a plurality of dividing walls projecting into the receiving space to divide the receiving space into a number of rooms each accommodating a corresponding magnetic component, each shielding plate being retained in one of the dividing walls.

20. The electrical connector as claimed in claim 17, wherein said inner printed circuit board is located above both the magnetic components and said shielding plates.

* * * * *